US010595578B2

(12) United States Patent
Szalkowski et al.

(10) Patent No.: US 10,595,578 B2
(45) **Date of Patent: *Mar. 24, 2020**

(54) HELMET RETENTION SYSTEM

(71) Applicant: Intellectual Property Holdings, LLC, Cleveland, OH (US)

(72) Inventors: Ron Szalkowski, Lakewood, OH (US); Bryan Stephen Javorek, Lyndhurst, OH (US); Joshua Schmidt, Lakewood, OH (US)

(73) Assignee: INTELLECTUAL PROPERTY HOLDINGS, LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/899,459

(22) Filed: Feb. 20, 2018

(65) Prior Publication Data

US 2018/0271199 A1 Sep. 27, 2018

Related U.S. Application Data

(63) Continuation of application No. 13/777,270, filed on Feb. 26, 2013, now Pat. No. 9,894,953.

(Continued)

(51) Int. Cl.
*A42B 3/08* (2006.01)
*A42B 3/14* (2006.01)

(52) U.S. Cl.
CPC ..... *A42B 3/08* (2013.01); *A42B 3/085* (2013.01); *A42B 3/145* (2013.01)

(58) Field of Classification Search
CPC ..... A42B 3/08; A42B 3/085; A42B 3/105; A42B 3/14; A42B 3/142; A42B 3/145;
(Continued)

(56) References Cited

U.S. PATENT DOCUMENTS 666,130 A 1/1901 Cole
957,394 A 5/1910 Thoma
(Continued)

FOREIGN PATENT DOCUMENTS

DE 4326049 A1 2/1995
EP 832571 A1 4/1998
(Continued)

OTHER PUBLICATIONS

International Search Report and Written Opinion from International Application No. PCT/US2011/038870 dated Oct. 26, 2011.
(Continued)

*Primary Examiner* — Alissa L Hoey
*Assistant Examiner* — Brieanna Szafran
(74) *Attorney, Agent, or Firm* — Calfee, Halter & Griswold LLP

(57) ABSTRACT

The present application discloses a helmet, a retention system for a helmet, and a method of adjusting a helmet. In certain embodiments, the helmet comprises a helmet shell and a retention system attached to the helmet shell. The retention system generally comprises a rear portion connected to the rear of the helmet shell, at least one strap extending from the rear portion to a front portion of the helmet shell, and an adjustment device attached to the rear portion and configured to selectively adjust the length of the strap between the rear portion and the front portion of the helmet shell.

20 Claims, 10 Drawing Sheets

Related U.S. Application Data

(60) Provisional application No. 61/709,437, filed on Oct. 4, 2012.

(58) Field of Classification Search
CPC A42B 3/147; A42B 3/04; A63B 71/10; A41F 15/007
See application file for complete search history.

(56) References Cited

U.S. PATENT DOCUMENTS 1,012,597 A 12/1911 Church
1,539,283 A 5/1925 Staats-Oels
1,552,965 A 9/1925 Smith
1,560,825 A 11/1925 Kelticka
1,958,050 A 5/1934 Koppelman
2,074,331 A 3/1937 Haider
2,090,881 A 8/1937 Wilson
2,221,310 A 11/1940 Gazelle
2,275,575 A 3/1942 Vrooman
2,285,335 A 6/1942 Hurt
2,303,744 A 12/1942 Jacobs
2,311,373 A 2/1943 Durning
2,318,077 A 5/1943 Jonas
2,346,161 A 4/1944 Grant
2,349,907 A 5/1944 Kos
2,433,012 A 12/1947 Zalicovitz
2,434,641 A 1/1948 Burns
2,649,019 A 8/1953 Hartline et al.
2,711,033 A 6/1955 Dick
2,739,093 A 3/1956 Bull
2,759,186 A 8/1956 Dye
2,772,196 A 11/1956 Pooley
2,776,452 A 1/1957 Chavannes
2,983,056 A 5/1961 Murawski
3,018,015 A 1/1962 Agriss et al.
3,026,231 A 3/1962 Chavannes
3,039,109 A 6/1962 Simpson
3,086,899 A 4/1963 Smith et al.
3,088,539 A 5/1963 Mathues et al.
3,099,043 A 7/1963 Held
3,124,807 A 3/1964 Frenkel et al.
3,142,599 A 7/1964 Chavannes
3,144,247 A 8/1964 Szonn et al.
3,153,792 A 10/1964 Marietta
3,160,963 A 12/1964 Aaskov
3,186,013 A 6/1965 Glassman et al.
3,195,686 A 7/1965 Johnson
3,231,454 A 1/1966 Williams
3,242,500 A 3/1966 Derr
3,251,076 A 5/1966 Burke
3,280,410 A 10/1966 Propst et al.
3,327,334 A 6/1967 Wilmanns et al.
3,342,666 A 9/1967 Hull
3,366,971 A 2/1968 Scherz
3,378,888 A 4/1968 Robertson
3,425,061 A 2/1969 Webb
3,447,163 A 6/1969 Bothwell et al.
3,484,835 A 12/1969 Trountine et al.
3,500,472 A 3/1970 Castellani
3,500,475 A 3/1970 Otsuka
3,507,727 A 4/1970 Marshack
3,508,992 A 4/1970 Chavannes et al.
3,514,156 A 5/1970 Fields
3,525,663 A 8/1970 Hale
3,538,628 A 11/1970 Einstein, Jr.
3,575,781 A 4/1971 Pezely
3,600,714 A 8/1971 Cade
3,608,215 A 9/1971 Fukuoka
3,609,764 A 10/1971 Morgan
3,618,144 A 11/1971 Frey et al.
3,633,228 A 1/1972 Zysman
3,668,056 A 6/1972 Hayes, Jr.
3,668,704 A 6/1972 Conroy
3,673,609 A 7/1972 De Simone
3,679,166 A 7/1972 Sturhan
3,684,235 A 8/1972 Schupbach
3,709,967 A 1/1973 Held, Jr.
3,713,640 A 1/1973 Margan
3,716,614 A 2/1973 Okamoto et al.
3,729,744 A 5/1973 Rappleyea
3,747,968 A 7/1973 Hornsby
3,761,959 A 10/1973 Dunning
3,766,669 A 10/1973 Pearsall
3,782,767 A 1/1974 Moore
3,783,450 A 1/1974 O Connor
3,784,985 A 1/1974 Conroy
3,806,950 A 4/1974 Spencer-Foote
3,837,991 A 9/1974 Evans
3,849,801 A 11/1974 Holt et al.
3,853,221 A 12/1974 Boyd
3,857,144 A 12/1974 Bustin
3,863,909 A 2/1975 Weber
3,871,636 A 3/1975 Boyle
3,872,511 A 3/1975 Nichols
3,877,076 A 4/1975 Summers
3,882,547 A 5/1975 Morgan
3,884,862 A 5/1975 King
3,895,456 A 7/1975 Fabre
3,900,222 A 8/1975 Muller
3,911,187 A 10/1975 Raley
3,926,463 A 12/1975 Landwehr
3,928,881 A 12/1975 Bente
3,933,387 A 1/1976 Salloum et al.
3,940,529 A 2/1976 Hepford et al.
3,940,811 A 3/1976 Tomikawa et al.
3,952,358 A 4/1976 Fukuoka
3,971,583 A 7/1976 Kornahuser
D241,228 S 8/1976 Boduch
3,994,020 A 11/1976 Villari
3,995,901 A 12/1976 Filbert, Jr.
3,997,207 A 12/1976 Norlin
3,999,220 A 12/1976 Keltner
4,022,505 A 5/1977 Saczawa, Jr.
4,023,213 A 5/1977 Rovani
4,029,350 A 6/1977 Goupy et al.
4,029,534 A 6/1977 Bocks et al.
4,038,700 A 8/1977 Gyory
4,044,399 A 8/1977 Morton
4,044,479 A 8/1977 Brutting
4,064,565 A 12/1977 Griffiths
4,067,063 A 1/1978 Ettinger
4,075,717 A 2/1978 Lemelson
4,077,393 A 3/1978 Mattson
4,099,759 A 7/1978 Kornhauser
4,101,983 A 7/1978 Dera et al.
4,106,745 A 8/1978 Carrow
4,110,857 A 9/1978 Banister
4,114,197 A 9/1978 Morton
4,134,156 A 1/1979 Gyory
4,151,661 A 5/1979 Namba
4,154,469 A 5/1979 Goupy et al.
4,154,489 A 5/1979 Lyman
4,170,078 A 10/1979 Moss
4,187,620 A 2/1980 Selner
4,190,276 A 2/1980 Hirano
4,192,699 A 3/1980 Lewicki et al.
4,213,202 A 7/1980 Larry
4,223,455 A 9/1980 Vermeulen
4,223,456 A 9/1980 Cohen
4,236,326 A 12/1980 Inohara
4,239,106 A 12/1980 Aileo
4,239,476 A 12/1980 Somberg
4,251,932 A 2/1981 Love
4,262,433 A 4/1981 Hagg
4,267,648 A 5/1981 Weisz
4,279,038 A 7/1981 Bruckner et al.
4,287,613 A 9/1981 Schulz
4,288,399 A 9/1981 Siedenstrang et al.
4,290,149 A 9/1981 Aileo
4,297,797 A 11/1981 Meyers
4,299,038 A 11/1981 Epple
4,302,892 A 12/1981 Adamik
4,305,212 A 12/1981 Coomer
4,307,471 A 12/1981 Lovell

(56) References Cited

U.S. PATENT DOCUMENTS 4,321,989 A 3/1982 Meinzer
4,338,371 A 7/1982 Dawn et al.
4,342,157 A 8/1982 Gilbert
4,342,158 A 8/1982 McMahon
4,345,338 A 8/1982 Frieder, Jr. et al.
4,347,637 A 9/1982 Ardito
4,352,484 A 10/1982 Gertz
4,355,792 A 10/1982 Fukuda
4,356,642 A 11/1982 Herman
D267,287 S 12/1982 Gooding
D267,831 S 2/1983 Sucato
4,370,754 A 2/1983 Donzis
4,372,058 A 2/1983 Stubblefield
4,377,042 A 3/1983 Bauer
4,391,048 A 7/1983 Lutz
4,398,357 A 8/1983 Batra
4,400,483 A 8/1983 Siedenstrang et al.
4,400,894 A 8/1983 Ehrlich
4,413,856 A 11/1983 McMahan et al.
4,418,483 A 12/1983 Fujita
4,423,000 A 12/1983 Teraoka
4,428,306 A 1/1984 Dresen et al.
4,432,099 A 2/1984 Grick et al.
4,439,936 A 4/1984 Clarke et al.
4,445,283 A 5/1984 Meyers
4,449,307 A 5/1984 Stubblefield
4,453,271 A 6/1984 Donzis
4,455,765 A 6/1984 Sjosward
4,458,430 A 7/1984 Peterson
4,460,205 A 7/1984 Glance
4,461,044 A 7/1984 Reiterman et al.
4,472,472 A 9/1984 Schultz
4,494,320 A 1/1985 Davis
4,497,123 A 2/1985 Ehrlich
4,510,702 A 4/1985 Ehrlich, Jr.
4,513,449 A 4/1985 Donzis
4,518,643 A 5/1985 Francis
4,523,393 A 6/1985 Inohara
4,534,068 A 8/1985 Mitchell et al.
4,535,553 A 8/1985 Derderian et al.
4,538,301 A 9/1985 Sawatzki et al.
4,538,366 A 9/1985 Norton
4,546,555 A 10/1985 Spademan
4,553,342 A 11/1985 Derderian et al.
4,558,470 A 12/1985 Mitchell et al.
4,562,651 A 1/1986 Frederick et al.
4,566,678 A 1/1986 Anderson
4,566,137 A 2/1986 Gooding
4,578,296 A 3/1986 Miyazaki
4,586,200 A 5/1986 Poon
4,601,367 A 7/1986 Bongers
4,614,000 A 9/1986 Mayer
4,616,431 A 10/1986 Dassler
4,619,055 A 10/1986 Davidson
4,624,061 A 11/1986 Wezel et al.
4,627,114 A 12/1986 Mitchell
4,631,221 A 12/1986 Disselbeck et al.
4,635,384 A 1/1987 Huh et al.
4,635,981 A 1/1987 Friton
4,642,814 A 2/1987 Godfrey
4,657,716 A 4/1987 Schmidt
4,666,130 A 5/1987 Denman et al.
4,667,423 A 5/1987 Autry et al.
4,670,995 A 6/1987 Huang
4,672,754 A 6/1987 Ehrlich
4,676,010 A 6/1987 Cheskin
4,680,875 A 6/1987 DAnieli
4,695,496 A 9/1987 Lee
4,700,403 A 10/1987 Vacanti
4,703,879 A 11/1987 Kastendieck et al.
4,704,746 A 11/1987 Nava
4,710,984 A 12/1987 Asper
4,720,261 A 1/1988 Fishwick et al.
4,722,131 A 2/1988 Huang
4,724,549 A 2/1988 Herder et al.
4,730,402 A 3/1988 Norton et al.
4,739,762 A 4/1988 Palmaz
4,741,114 A 5/1988 Stubblefield
4,753,021 A 6/1988 Cohen
4,759,136 A 7/1988 Stewart et al.
4,763,426 A 8/1988 Polus et al.
4,766,614 A 8/1988 Cantwell et al.
4,768,295 A 9/1988 Ito
4,798,009 A 1/1989 Colonel et al.
4,808,469 A 2/1989 Hiles
4,815,221 A 3/1989 Diaz
4,817,304 A 4/1989 Parker et al.
4,823,483 A 4/1989 Chapnick
4,831,750 A 5/1989 Muller
4,856,208 A 5/1989 Zaccaro
4,838,606 A 6/1989 Furubayashi et al.
4,842,931 A 6/1989 Zook
4,843,741 A 7/1989 Yung-Mao
4,844,213 A 7/1989 Travis
4,845,786 A 7/1989 Chiarella
4,845,861 A 7/1989 Moundjian
4,845,863 A 7/1989 Yung-Mao
4,852,704 A 8/1989 Brockenbrough
4,856,833 A 8/1989 Beekman
4,858,343 A 8/1989 Flemming
4,858,606 A 8/1989 Hamlin
4,872,220 A 10/1989 Haruvy et al.
4,876,053 A 10/1989 Norton
4,883,299 A 11/1989 Bonar
4,887,369 A 12/1989 Bailey
4,890,877 A 1/1990 Ashtiani-Zarandi et al.
4,899,467 A 2/1990 Mackey
4,901,987 A 2/1990 Greenhill et al.
4,904,008 A 2/1990 Glance
4,905,382 A 3/1990 Yung-Mao
4,909,661 A 3/1990 Ivey
4,912,861 A 4/1990 Huang
4,916,759 A 4/1990 Arai
4,918,841 A 4/1990 Turner
4,920,663 A 5/1990 Flemming
4,922,630 A 5/1990 Robinson
4,922,631 A 5/1990 Anderie
4,923,650 A 5/1990 Antoon, Jr. et al.
4,925,224 A 5/1990 Smiszek
4,930,231 A 6/1990 Liu
4,931,115 A 6/1990 Pajunen
4,934,071 A 6/1990 Virgini
4,941,701 A 7/1990 Loren
4,951,986 A 8/1990 Hanfusa et al.
D310,893 S 9/1990 Broersma
4,969,680 A 11/1990 Shimoda
4,970,729 A 11/1990 Shimazaki
4,972,611 A 11/1990 Swartz
4,984,320 A 1/1991 Curley, Jr. et al.
4,987,609 A 1/1991 Zahn
4,993,173 A 2/1991 Gardener
4,999,931 A 4/1991 Welygan et al.
5,011,642 A 4/1991 Welygan et al.
5,014,449 A 5/1991 Richard et al.
5,014,691 A 5/1991 Cueman et al.
5,016,417 A 5/1991 Mentken
5,025,504 A 6/1991 Benston et al.
5,027,803 A 7/1991 Scholtz et al.
5,030,501 A 7/1991 Colvin et al.
5,033,593 A 7/1991 Kazuhito
5,035,009 A 7/1991 Wingo, Jr. et al.
5,035,758 A 7/1991 Degler et al.
5,042,174 A 8/1991 Nichols
5,042,175 A 8/1991 Romen et al.
5,042,176 A 8/1991 Zhang et al.
5,042,859 A 8/1991 Zhang et al.
5,044,096 A 9/1991 Polegato
5,046,267 A 9/1991 Kilgore et al.
5,048,203 A 9/1991 Kling
5,056,162 A 10/1991 Tirums
5,058,212 A 10/1991 Kamata
5,066,400 A 11/1991 Rocklitz et al.
5,068,922 A 12/1991 Zahn
5,083,320 A 1/1992 Halstead

(56) References Cited

U.S. PATENT DOCUMENTS

| | | | |
|---|---|---|---|
| 5,083,361 | A | 1/1992 | Rudy |
| 5,086,033 | A | 2/1992 | Armor et al. |
| 5,092,060 | A | 3/1992 | Frachey et al. |
| 5,093,938 | A | 3/1992 | Kamata |
| 5,097,607 | A | 3/1992 | Fredericksen |
| 5,098,124 | A | 3/1992 | Breed et al. |
| 5,124,191 | A | 6/1992 | Seksaria |
| 5,131,174 | A | 7/1992 | Drew et al. |
| 5,150,935 | A | 9/1992 | Glance et al. |
| 5,165,990 | A | 11/1992 | Nakano |
| 5,168,576 | A | 12/1992 | Krent et al. |
| 5,175,889 | A | 1/1993 | Infusino |
| 5,204,998 | A | 4/1993 | Liu |
| 5,235,715 | A | 8/1993 | Donzis |
| 5,244,277 | A | 9/1993 | Broussalian et al. |
| 5,244,745 | A | 9/1993 | Seksaria et al. |
| 5,263,203 | A | 11/1993 | Kraemer et al. |
| 5,271,103 | A | 12/1993 | Darnell |
| 5,274,846 | A | 1/1994 | Kolsky |
| 5,282,288 | A | 2/1994 | Henson |
| 5,289,890 | A | 3/1994 | Toyoda et al. |
| 5,324,460 | A | 6/1994 | Briggs |
| 5,330,249 | A | 7/1994 | Weber et al. |
| 5,376,318 | A | 12/1994 | Ho |
| 5,409,200 | A | 4/1995 | Zingher et al. |
| 5,421,035 | A | 6/1995 | Klose et al. |
| 5,423,087 | A | 6/1995 | Krent et al. |
| 5,439,733 | A | 8/1995 | Paire |
| D364,487 | S | 11/1995 | Tutton et al. |
| 5,477,558 | A | 12/1995 | Volker et al. |
| 5,493,791 | A | 2/1996 | Kramer |
| 5,543,194 | A | 8/1996 | Rudy |
| 5,545,128 | A | 8/1996 | Hayes et al. |
| 5,551,094 | A | 9/1996 | Navone |
| 5,555,584 | A | 9/1996 | Moore et al. |
| 5,572,749 | A | 11/1996 | Ogden |
| 5,572,804 | A | 11/1996 | Skaja et al. |
| 5,581,818 | A | 12/1996 | Lorenzi et al. |
| 5,588,165 | A | 12/1996 | Fromme |
| 5,591,379 | A | 1/1997 | Shores |
| 5,595,003 | A | 1/1997 | Snow |
| 5,598,588 | A | 2/1997 | Lee |
| 5,611,153 | A | 3/1997 | Fisher et al. |
| 5,655,226 | A | 8/1997 | Williams |
| 5,669,079 | A | 9/1997 | Morgan |
| 5,734,994 | A | 4/1998 | Rogers |
| 5,741,568 | A | 4/1998 | Rudy |
| 5,766,704 | A | 6/1998 | Allen et al. |
| 5,891,372 | A | 4/1999 | Besset et al. |
| 5,913,412 | A | 6/1999 | Huber et al. |
| 5,915,537 | A | 6/1999 | Dallas et al. |
| 5,946,734 | A | 9/1999 | Vogan |
| 5,950,244 | A | 9/1999 | Fournier et al. |
| D415,420 | S | 10/1999 | Chen |
| 5,976,451 | A | 11/1999 | Skaja et al. |
| 5,983,405 | A | 11/1999 | Casale |
| 5,992,054 | A | 11/1999 | Rauch |
| 5,996,126 | A | 12/1999 | Barthold et al. |
| 6,029,962 | A | 2/2000 | Shorten et al. |
| 6,051,624 | A | 4/2000 | Bastin et al. |
| D424,246 | S | 5/2000 | Ho |
| D426,032 | S | 5/2000 | Ho |
| 6,070,271 | A | 6/2000 | Williams |
| 6,085,878 | A | 7/2000 | Araki et al. |
| 6,093,468 | A | 7/2000 | Toms et al. |
| 6,098,313 | A | 8/2000 | Skaja |
| 6,105,162 | A | 8/2000 | Douglas et al. |
| 6,105,176 | A | 8/2000 | Egger |
| 6,108,825 | A | 8/2000 | Bell et al. |
| 6,154,889 | A | 12/2000 | Moore, III et al. |
| 6,199,942 | B1 | 3/2001 | Carroll et al. |
| 6,219,850 | B1 | 4/2001 | Halstead et al. |
| 6,226,801 | B1 | 5/2001 | Alexander et al. |
| 6,247,745 | B1 | 6/2001 | Carroll et al. |
| D447,604 | S | 9/2001 | Watters et al. |
| 6,298,497 | B1 | 10/2001 | Chartrand |
| 6,326,077 | B1 | 12/2001 | Monaci |
| 6,351,854 | B1 | 3/2002 | Whalen et al. |
| 6,353,953 | B1 | 3/2002 | Tanaka et al. |
| D455,522 | S | 4/2002 | Royes et al. |
| 6,378,140 | B1 | 4/2002 | Abraham et al. |
| 6,381,759 | B1 | 5/2002 | Katz |
| 6,383,431 | B1 | 5/2002 | Dobrin et al. |
| 6,391,935 | B1 | 5/2002 | Hager et al. |
| 6,425,141 | B1 | 7/2002 | Ewing et al. |
| 6,434,755 | B1 | 8/2002 | Halstead et al. |
| 6,446,270 | B1 | 9/2002 | Durr |
| 6,453,476 | B1 | 9/2002 | Moore, III |
| D464,174 | S | 10/2002 | Lu |
| 6,457,261 | B1 | 10/2002 | Crary |
| 6,460,207 | B1 | 10/2002 | Papay et al. |
| 6,467,099 | B2 | 10/2002 | Dennis et al. |
| 6,485,446 | B1 | 11/2002 | Brother et al. |
| 6,499,147 | B2 | 12/2002 | Schiebl et al. |
| 6,532,602 | B2 | 3/2003 | Watters et al. |
| 6,533,258 | B2 | 3/2003 | Monson et al. |
| 6,536,052 | B2 | 3/2003 | Tao et al. |
| 6,550,850 | B2 | 4/2003 | Laborie et al. |
| D475,486 | S | 6/2003 | Ide et al. |
| 6,604,246 | B1 | 8/2003 | Obreja |
| D481,171 | S | 10/2003 | Ho |
| 6,634,045 | B1 | 10/2003 | DuDonis et al. |
| 6,658,671 | B1 | 12/2003 | Von Holst et al. |
| 6,671,889 | B2 | 1/2004 | Dennis et al. |
| 6,679,544 | B1 | 1/2004 | Hubbert et al. |
| 6,679,967 | B1 | 1/2004 | Carroll, III et al. |
| 6,681,409 | B2 | 1/2004 | Dennis et al. |
| 6,682,128 | B2 | 1/2004 | Carroll, III et al. |
| D491,695 | S | 6/2004 | Long |
| 6,752,450 | B2 | 6/2004 | Carroll, III et al. |
| D492,818 | S | 7/2004 | Ide et al. |
| D495,096 | S | 8/2004 | Long |
| 6,803,005 | B2 | 10/2004 | Dennis et al. |
| 6,926,947 | B1 | 8/2005 | Seckel |
| 6,994,333 | B2 | 2/2006 | Lobry et al. |
| D521,191 | S | 5/2006 | Berger |
| D523,180 | S | 6/2006 | Frye |
| 7,078,443 | B2 | 7/2006 | Milliren |
| D535,059 | S | 1/2007 | Lam |
| 7,178,175 | B2 | 2/2007 | Rogers et al. |
| D541,480 | S | 4/2007 | Turner |
| 7,228,648 | B2 | 6/2007 | Yang |
| 7,240,376 | B2 | 7/2007 | Ide et al. |
| 7,255,910 | B1 | 8/2007 | Seckel |
| 7,299,505 | B2 | 11/2007 | Dennis et al. |
| 7,316,036 | B2 | 1/2008 | Rudolf et al. |
| 7,338,038 | B2 | 3/2008 | Maurer et al. |
| 7,341,776 | B1 | 3/2008 | Milliren et al. |
| 7,360,882 | B2 | 4/2008 | Ikeda et al. |
| D570,055 | S | 5/2008 | Ferrara et al. |
| 7,377,577 | B2 | 5/2008 | Carroll, III et al. |
| 7,384,095 | B2 | 6/2008 | Cormier |
| D572,865 | S | 7/2008 | Baker |
| 7,404,593 | B2 | 7/2008 | Cormier |
| D577,866 | S | 9/2008 | Frye et al. |
| D581,599 | S | 11/2008 | Ferrara et al. |
| D582,607 | S | 12/2008 | Ferrara et al. |
| 7,458,172 | B2 | 12/2008 | Aveni |
| 7,464,414 | B2 | 12/2008 | McDuff |
| D584,456 | S | 1/2009 | Ferrara |
| 7,513,344 | B2 | 4/2009 | Toccalino |
| 7,574,760 | B2 | 8/2009 | Foley et al. |
| D603,103 | S | 10/2009 | Ferrara et al. |
| 7,600,268 | B2 | 10/2009 | Rogers et al. |
| 7,603,725 | B2 | 10/2009 | Harris |
| 7,625,023 | B2 | 12/2009 | Audi et al. |
| D608,688 | S | 1/2010 | Dalzell et al. |
| 7,673,351 | B2 | 3/2010 | Copeland et al. |
| 7,676,854 | B2 | 3/2010 | Berger et al. |
| 7,677,538 | B2 | 3/2010 | Darnell et al. |
| D617,503 | S | 6/2010 | Szalkowski |
| 7,730,635 | B2 | 6/2010 | Aveni et al. |
| D621,099 | S | 8/2010 | Johnson et al. |
| D622,449 | S | 8/2010 | Culley et al. |

(56) References Cited

U.S. PATENT DOCUMENTS

| | | | |
|---|---|---|---|
| 7,770,239 | B1 | 8/2010 | Goldman et al. |
| 7,774,866 | B2 | 8/2010 | Ferrara |
| 7,802,320 | B2 | 9/2010 | Morgan |
| 7,827,617 | B2 | 11/2010 | Trainor et al. |
| 7,857,610 | B2 | 12/2010 | Rossi et al. |
| 7,866,248 | B2 | 1/2011 | Moore, III et al. |
| 7,895,681 | B2 | 3/2011 | Ferrara |
| D637,356 | S | 5/2011 | Green et al. |
| 7,950,073 | B2 | 5/2011 | Ferrara |
| D640,422 | S | 6/2011 | Green et al. |
| 7,959,023 | B2 | 6/2011 | Ferrara |
| D645,210 | S | 9/2011 | Chilson et al. |
| 8,039,078 | B2 | 10/2011 | Moore, III et al. |
| 8,047,602 | B2 | 11/2011 | Sielhorst et al. |
| 8,056,972 | B2 | 11/2011 | Marsden et al. |
| D650,132 | S | 12/2011 | Chilson et al. |
| 8,069,498 | B2 | 12/2011 | Maddux et al. |
| 8,087,187 | B2 | 1/2012 | Aveni et al. |
| 8,104,593 | B2 | 1/2012 | Lin |
| D654,628 | S | 2/2012 | Aris et al. |
| D655,048 | S | 2/2012 | Moeller et al. |
| D655,051 | S | 2/2012 | O'Keefe et al. |
| 8,201,269 | B2 | 6/2012 | Maddux et al. |
| 8,205,272 | B2 | 6/2012 | Green et al. |
| D663,076 | S | 7/2012 | Parsons et al. |
| 8,220,072 | B2 | 7/2012 | Dodd |
| D665,663 | S | 8/2012 | Krupa |
| D666,779 | S | 9/2012 | Harris |
| 8,298,648 | B2 | 10/2012 | Turner et al. |
| 8,348,031 | B2 | 1/2013 | Smaldone et al. |
| 8,353,066 | B2 | 1/2013 | Rogers et al. |
| D677,006 | S | 2/2013 | Pfanner et al. |
| D679,058 | S | 3/2013 | Szalkowski et al. |
| 8,387,164 | B2 | 3/2013 | Maddux et al. |
| 8,399,085 | B2 | 3/2013 | Moore, III et al. |
| D683,905 | S | 6/2013 | Wills |
| D691,329 | S | 10/2013 | Anderson |
| 8,544,117 | B2 | 10/2013 | Erb et al. |
| 8,561,214 | B2 | 10/2013 | Turner |
| 8,590,869 | B2 | 11/2013 | Tavares et al. |
| 8,702,865 | B2 | 4/2014 | Miyanaga et al. |
| 8,713,719 | B2 | 5/2014 | Turner |
| 8,726,424 | B2 | 5/2014 | Thomas et al. |
| 8,863,320 | B2 | 10/2014 | Kelly et al. |
| 8,950,735 | B2 | 2/2015 | Reynolds et al. |
| 8,959,723 | B2 | 2/2015 | Gennrich et al. |
| 9,066,551 | B2 | 6/2015 | Van Waes |
| 9,131,744 | B2 | 9/2015 | Erb et al. |
| 9,320,311 | B2 | 4/2016 | Szalkowski et al. |
| 9,894,953 | B2 | 2/2018 | Szalkowski et al. |
| 2002/0012978 | A1 | 1/2002 | Nagasawa et al. |
| 2002/0017805 | A1 | 2/2002 | Carroll, III et al. |
| 2002/0023290 | A1 | 2/2002 | Watters et al. |
| 2002/0152542 | A1 | 10/2002 | Dennis et al. |
| 2002/0163114 | A1 | 11/2002 | Lobry et al. |
| 2002/0168496 | A1 | 11/2002 | Morimoto et al. |
| 2003/0106138 | A1 | 6/2003 | Guay |
| 2003/0200677 | A1 | 10/2003 | Abraham |
| 2003/0217483 | A1 | 11/2003 | Abraham |
| 2003/0230866 | A1 | 12/2003 | Lee |
| 2004/0028860 | A1 | 2/2004 | Dalal et al. |
| 2004/0117897 | A1 | 6/2004 | Udelhofen et al. |
| 2004/0139531 | A1 | 7/2004 | Moore, III et al. |
| 2004/0154191 | A1 | 8/2004 | Park |
| 2004/0188898 | A1 | 9/2004 | Siefermann et al. |
| 2004/0199981 | A1 | 10/2004 | Tucker |
| 2004/0200094 | A1 | 10/2004 | Baychar |
| 2005/0050617 | A1 | 3/2005 | Moore et al. |
| 2005/0060793 | A1 | 3/2005 | Rosie |
| 2005/0166302 | A1 | 8/2005 | Dennis |
| 2005/0196592 | A1 | 9/2005 | Tao et al. |
| 2005/0210567 | A1 | 9/2005 | Rogers et al. |
| 2005/0217006 | A1 | 10/2005 | Sutter et al. |
| 2005/0268383 | A1 | 12/2005 | Harris |
| 2006/0059605 | A1 | 3/2006 | Ferrara |
| 2006/0059606 | A1 | 3/2006 | Ferrara |
| 2006/0064900 | A1 | 3/2006 | Aveni |
| 2006/0070170 | A1 | 4/2006 | Copeland et al. |
| 2006/0101559 | A1 | 5/2006 | Moore et al. |
| 2006/0177635 | A1 | 8/2006 | Pepe et al. |
| 2006/0195974 | A1 | 9/2006 | Burkhart et al. |
| 2007/0000032 | A1 | 1/2007 | Morgan |
| 2007/0083965 | A1 | 4/2007 | Darnell et al. |
| 2007/0089219 | A1 | 4/2007 | Trainor et al. |
| 2007/0190292 | A1 | 8/2007 | Ferrara |
| 2007/0190293 | A1 | 8/2007 | Ferrara |
| 2007/0281125 | A1 | 12/2007 | Moore, III et al. |
| 2008/0035442 | A1 | 2/2008 | Spingler |
| 2008/0036242 | A1 | 2/2008 | Glance et al. |
| 2008/0155735 | A1 | 7/2008 | Ferrara |
| 2008/0166524 | A1 | 7/2008 | Skaja et al. |
| 2008/0236378 | A1 | 10/2008 | Sane et al. |
| 2008/0256686 | A1 | 10/2008 | Ferrara |
| 2008/0307568 | A1 | 12/2008 | Sajic |
| 2009/0038955 | A1 | 2/2009 | Ferrara |
| 2009/0049586 | A1 | 2/2009 | Wirthenstaetter |
| 2009/0106882 | A1 | 4/2009 | Nimmons et al. |
| 2009/0114083 | A1 | 5/2009 | Moore, III et al. |
| 2009/0178184 | A1 | 7/2009 | Brine, III et al. |
| 2009/0179361 | A1 | 7/2009 | Vito et al. |
| 2009/0210998 | A1 | 8/2009 | Rolla |
| 2009/0222975 | A1 | 9/2009 | Green et al. |
| 2009/0265841 | A1 | 10/2009 | Ferrara |
| 2009/0289026 | A1 | 11/2009 | Ferrara |
| 2010/0000009 | A1 | 1/2010 | Morgan |
| 2010/0037482 | A1 | 2/2010 | Litchfield et al. |
| 2010/0129573 | A1 | 5/2010 | Kim |
| 2010/0186150 | A1 | 7/2010 | Ferrara et al. |
| 2010/0258988 | A1 | 10/2010 | Darnell et al. |
| 2010/0264571 | A1 | 10/2010 | Tarazona De La Asuncion |
| 2010/0273944 | A1 | 10/2010 | Kobayashi et al. |
| 2010/0295221 | A1 | 11/2010 | Kligerman et al. |
| 2010/0295270 | A1 | 11/2010 | Marsden et al. |
| 2010/0299812 | A1 | 12/2010 | Maddux et al. |
| 2010/0299813 | A1 | 12/2010 | Morgan |
| 2011/0004971 | A1 | 1/2011 | Benderradji |
| 2011/0047678 | A1 | 3/2011 | Barth et al. |
| 2011/0047685 | A1 | 3/2011 | Ferrara |
| 2011/0061154 | A1 | 3/2011 | Turner et al. |
| 2011/0074075 | A1 | 3/2011 | Henry, Jr. et al. |
| 2011/0094018 | A1 | 4/2011 | Rogers et al. |
| 2011/0107503 | A1 | 5/2011 | Morgan |
| 2011/0112448 | A1 | 5/2011 | Wu |
| 2011/0131695 | A1 | 6/2011 | Maddux et al. |
| 2011/0167542 | A1 | 7/2011 | Bayne et al. |
| 2011/0198788 | A1 | 8/2011 | Hines |
| 2011/0247744 | A1 | 10/2011 | Turner |
| 2011/0277222 | A1 | 11/2011 | Garneau et al. |
| 2011/0296594 | A1 | 12/2011 | Thomas et al. |
| 2012/0017358 | A1 | 1/2012 | Princip et al. |
| 2012/0036620 | A1 | 2/2012 | Harris |
| 2012/0060251 | A1 | 3/2012 | Schimpf |
| 2012/0079646 | A1 | 4/2012 | Belanger et al. |
| 2012/0174293 | A1 | 7/2012 | Milliren et al. |
| 2013/0152287 | A1 | 6/2013 | Cormier et al. |
| 2013/0153350 | A1 | 6/2013 | Ferrara et al. |
| 2013/0239303 | A1 | 9/2013 | Cotterman et al. |
| 2014/0096310 | A1 | 4/2014 | Szalkowski et al. |
| 2014/0325745 | A1 | 11/2014 | Erb et al. |

FOREIGN PATENT DOCUMENTS

| | | | |
|---|---|---|---|
| EP | 926960 | A1 | 7/1999 |
| GB | 1060567 | A | 3/1967 |
| JP | 2006188771 | A | 7/2006 |
| WO | 91/05489 | | 5/1991 |
| WO | 2006/005189 | | 1/2006 |
| WO | 2006022679 | A1 | 3/2006 |
| WO | 2006/088500 | | 8/2006 |
| WO | 2006/089098 | | 8/2006 |
| WO | 2006/089235 | | 8/2006 |
| WO | 2007/035800 | | 3/2007 |
| WO | 2008011708 | | 1/2008 |
| WO | 2008/105840 | | 9/2008 |

(56) References Cited

FOREIGN PATENT DOCUMENTS

| | | |
|---|---|---|
| WO | 2008/140650 | 11/2008 |
| WO | 2009/020583 | 2/2009 |
| WO | 2009/134334 | 11/2009 |
| WO | 2010/087957 | 8/2010 |

OTHER PUBLICATIONS

Response to Office Action dated Sep. 1, 2016 from U.S. Appl. No. 14/524,675 dated Dec. 1, 2016.
Office Action from U.S. Appl. No. 14/524,675 dated Jan. 27, 2017.
Office Action from U.S. Appl. No. 14/524,675 dated Sep. 1, 2016.
Office Action from U.S. Appl. No. 14/254,505 dated Sep. 8, 2016.
Notice of Allowance from U.S. Appl. No. 13/535,767 dated Oct. 21, 2016.
Response to Office Action dated Apr. 29, 2016 from U.S. Appl. No. 14/524,675 dated Jul. 29, 2016.
Office Action from U.S. Appl. No. 13/535,767 dated Apr. 18, 2016.
Office Action from U.S. Appl. No. 13/535,767 dated Sep. 2, 2015.
Office Action from U.S. Appl. No. 14/524,675 dated Dec. 8, 2015.
European Search Report from EP Application No. 13844406 dated Jul. 10, 2015.
Final Office Action from U.S. Appl. No. 14/524,675 dated Apr. 29, 2016.
Office Action for U.S. Appl. No. 12/792,858 dated Oct. 24, 2012.

HELMET RETENTION SYSTEM

CROSS REFERENCE TO RELATED APPLICATION

This application is a continuation of U.S. Non-Provisional patent application Ser. No. 13/777,270 which claims priority to U.S. Provisional Patent Application No. 61/709,437, filed on Oct. 4, 2012 and titled "Helmet Retention System," which is hereby incorporated by reference in its entirety.

BACKGROUND

Helmets generally include a shell, liner, and retention system. The helmet shell provides protection from protruding objects and is often configured to spread the impact load across the footprint of the helmet. The helmet liner is generally made of a softer and lower density material than the helmet shell. The helmet liner is often configured such that, upon impact, the helmet liner at least partially absorbs the impact energy from the force of an impact. The helmet retention system is generally configured to retain the helmet on the head of the user.

SUMMARY

The present application discloses a helmet, a retention system for a helmet, and a method of adjusting a helmet.

In certain embodiments, the helmet comprises a helmet shell and a retention system attached to the helmet shell. The retention system generally comprises a rear portion connected to the rear of the helmet shell, at least one strap extending from the rear portion to a front portion of the helmet shell, and an adjustment device attached to the rear portion and configured to selectively adjust the length of the strap between the rear portion and the front portion of the helmet shell. The strap generally comprises a strap segment extending from the rear portion and an elongated member attached to the strap segment and movable relative to the helmet shell. The adjustment device is configured to selectively adjust the elongated member to move the strap segment relative to the helmet shell and adjust the length of the strap between the rear portion and the front portion of the helmet shell.

In certain embodiments, the method of adjusting the helmet comprises utilizing a retention system of the present application to stabilize the helmet on a user's head. The retention system generally comprises a rear portion connected to the rear of the helmet shell, at least one strap extending from the rear portion to a front portion of the helmet shell, and an adjustment device attached to the rear portion. The strap generally comprises a strap segment extending from the rear portion and an elongated member attached to the strap segment and movable relative to the helmet shell. The adjustment device is used to selectively adjust the elongated member and move the strap segment relative to the helmet shell to adjust the length of the strap between the rear portion and the front portion of the helmet shell.

DESCRIPTION OF EMBODIMENTS

The present application discloses a helmet, a retention system for a helmet, and a method of adjusting a retention system for a helmet. The retention system generally comprises a rear portion, a plurality of straps, and an adjustment device for adjusting one or more of the straps.

In the embodiments disclosed herein, the retention system is described for use with a military helmet shell. Examples of such military helmet shells include a US Army Advanced Combat Helmet (ACH), a US Marine Corp Lightweight Helmet (LWH), an Enhanced Combat Helmet (ECH), a Personal Armor System for Ground Troops (PASGT) helmet, or other typical ballistic helmet shells. However, the retention system may also be used with a variety of other helmets, including, but not limited to, tactical helmets, aircrew and flight helmets, sporting helmets, such as football, lacrosse, hockey, multi-sport, cycling, whitewater, climbing, softball, or baseball helmets, or safety helmets, such as industrial or construction helmets.

The present application discusses adjustment of the length of straps between two points. Adjustment of the length of a strap between two points means the distance between the two points is adjusted (i.e., increased or decreased). For example, straps between a chin portion and a rear portion of the retention system may be selectively adjusted to increase or decrease the distance between the chin portion and the rear portion. Further, any one or more straps of the present application may comprise one or a plurality of strap segments or other components, such as lacing or wire. For example, a strap between two points may comprise a strap segment and lacing attached to the strap segment. Selective adjustment of the length of the strap, such as, for example, by adjusting the lacing attached to the strap segment, increases or decreases the distance between the two points.

Figure 1:
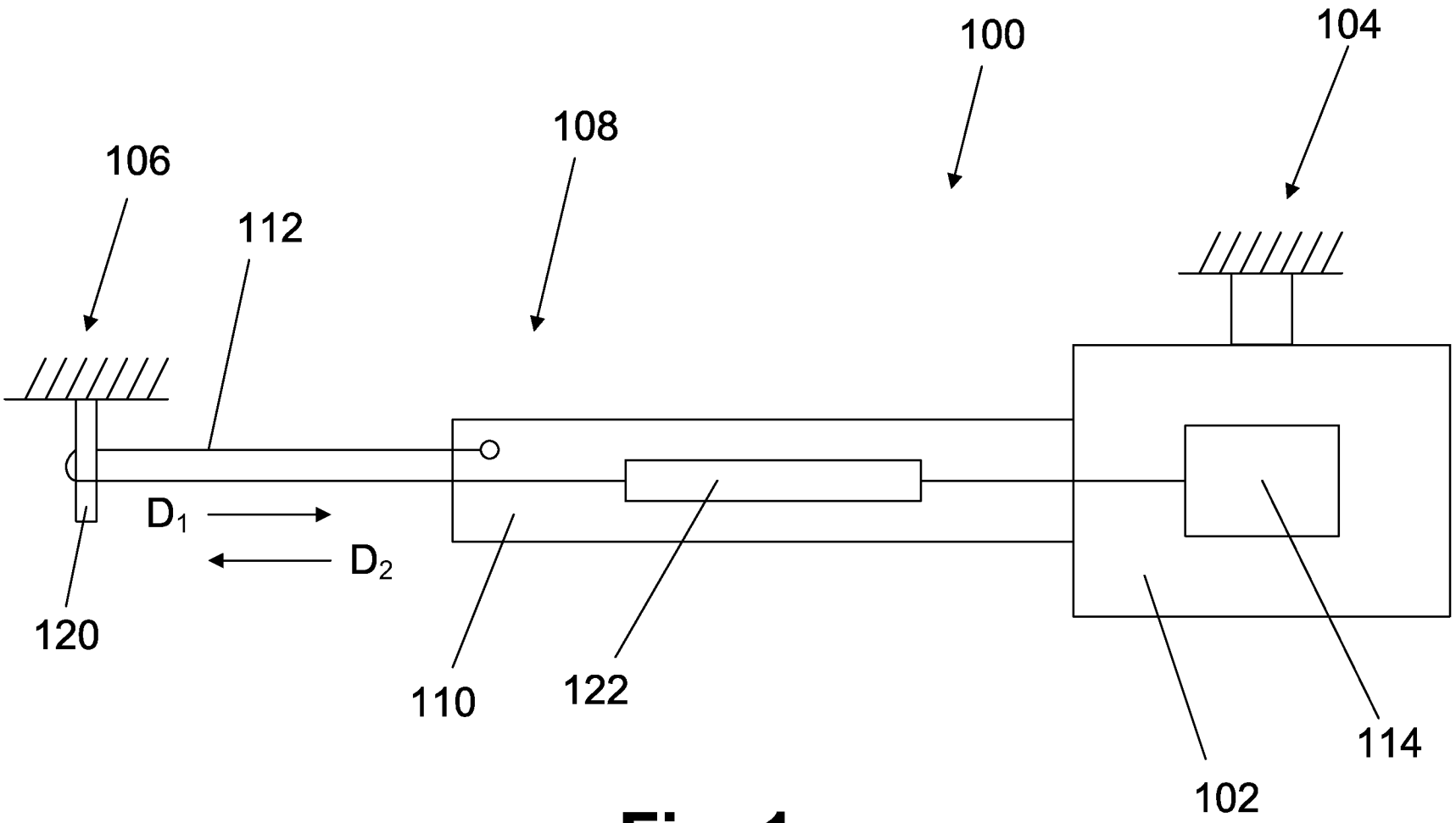
FIG. 1 is a schematic illustrating a helmet retention system according to an embodiment of the present application.

FIG. 1 schematically illustrates a retention system 100 according to an embodiment of the present application. The retention system 100 comprises a rear portion 102 attached to a rear 104 of a helmet shell, at least one flexible strap 108 extending from the rear portion to a front portion 106 of the helmet shell, and an adjustment device 114 attached to the rear portion for adjusting the length of the strap between the rear portion and the front portion of the helmet shell. The adjustment device 114 may be a variety of devices capable of adjusting the length of the strap 108, such as, for example, wire, lacing, or belt systems in which a flexible wire, lace, or belt may be adjusted by winding and unwinding, retracting, or otherwise altering the free length of the wire, lace, or belt, or a system with a rigid or semi-rigid strap that can be driven with a rack and pinion gear, worm drive, or other mechanism to alter the free length of the strap. In certain embodiments, the adjustment device 114 is a lacing device.

As illustrated in FIG. 1, the strap 108 comprises a flexible strap segment 110 and a flexible elongated member 112, such as, e.g., a wire, lace, or belt, attached to the strap segment. The elongated member 112 extends from the strap segment 110, through a securing member 120 of the helmet, through an attachment portion 122 of the strap segment, and to the adjustment device 114. The adjustment device 114 is configured to adjust the elongated member 112 by selectively altering the free length of the member. The attachment portion 122 attaches the elongated member 112 to the strap segment 110 and permits the member to move relative to the strap segment. The attachment portion 122 may be shaped and configured in a variety ways, such as, for example, a tube or conduit, one or more eyelets or arches, a sheath, a sleeve, a pocket, a passage, one or more slots or openings in the strap segment, or the like. The elongated member 112 may comprise a variety of materials, including steel, plastic, or fabric. In one embodiment, the elongated member 112 is made from Aircraft grade stainless steel.

When the adjustment device 114 is manipulated to retract the elongated member 112 into the adjustment device, the elongated member is moved in a first direction D1 through the attachment member 122 and the securing member 120. Further, the strap segment 110 is pulled toward the securing member 120. The securing member 120 may be attached directly or indirectly to the helmet. In certain embodiments, the securing member 120 comprises a strap segment that is configured to be attached to the helmet and a clip that movably attaches the elongated member 112 to the strap segment. However, a variety of other means for movably attaching the elongated member to the helmet may be used. For example, in certain embodiments, an opening in the helmet, an opening in a strap segment, an eyelet, a loop, a ring, a clip, a sheath, a sleeve, a passage, a conduit, a buckle, a fastener, or the like may be used to movably attach the elongated member to the helmet.

In certain embodiments, the securing member 120 is attached at the right and/or left front side or temple portion of the helmet. Thus, when the elongated member 112 is retracted into the adjustment device 114, at least a portion of the strap 108 is tightened against the side of the user's head and the rear portion 102 is pulled in a direction forward and upward against the rear of the user's head. Further, the retention system 100 is generally configured with straps 108 extending from the rear portion 102 on both the right and left sides of the helmet. As such, retraction of the elongated members 112 of the right and left straps 108 will fit the retention system 100 around the circumference of the user's head and stabilize the helmet shell on the user's head.

When the adjustment device 114 is manipulated to release the elongated member 112 and permit the member to be pulled out of the adjustment device, the elongated member is permitted to move in a second direction D2 through the attachment member 122 and the securing member 120. Further, the strap segment 110 is permitted to move away from the securing member 120. As such, the strap 108 and the rear portion 102 of the retention system 100 are loosened to facilitate removal of the helmet shell from the user's head. In certain embodiments, the adjustment device 114 may be used to move the elongated member 112 in the second direction D2 through the attachment member 122 and the securing member 120. Further, the adjustment device 114 may be used to move the strap segment 110 away from the securing member 120.

The rear portion 102 of the retention system 100 is generally configured to contact the rear of the user's head, e.g., the occipital or suboccipital portion of the head, and/or the nape of the user's neck and acts as an anchor point of the system. The rear portion may or may not extend below the rear edge of the helmet shell such that it is exposed and accessible to the user when wearing the helmet. The rear portion 102 may also be a variety of shapes and sizes, e.g., the rear portion may be shaped as a truncated triangle, square, rectangle, circle, or any other shape. The rear portion 102 may comprise padding material (e.g., foam) with a canvas covering. However, in certain embodiments, the rear portion may or may not be padded and may include one or more pieces of fabric or polymer material.

In certain embodiments, the retention system of the present application comprises a chin portion, a rear portion, a plurality of straps, and a lacing device for adjusting one or more of the straps. The chin portion is generally configured to receive the chin of a person wearing the helmet. The rear portion is connected to the chin portion and the rear of the helmet. A pair of first straps extend from the chin portion to the rear portion and the length of each first strap between the chin portion and rear portion is selectively adjustable. A pair of second straps extend from the chin portion to the front of the helmet and the length of each second strap between the chin portion and the front of the helmet is selectively adjustable. A pair of third straps extend from the rear portion to the front of the helmet. Each third strap comprises a strap segment and a lace portion attached to the strap segment. The lacing device is attached to the rear portion and configured to selectively adjust the lace portions relative to the lacing device to adjust a length of each third strap between the rear portion and the front of the helmet.

Figure 2A:
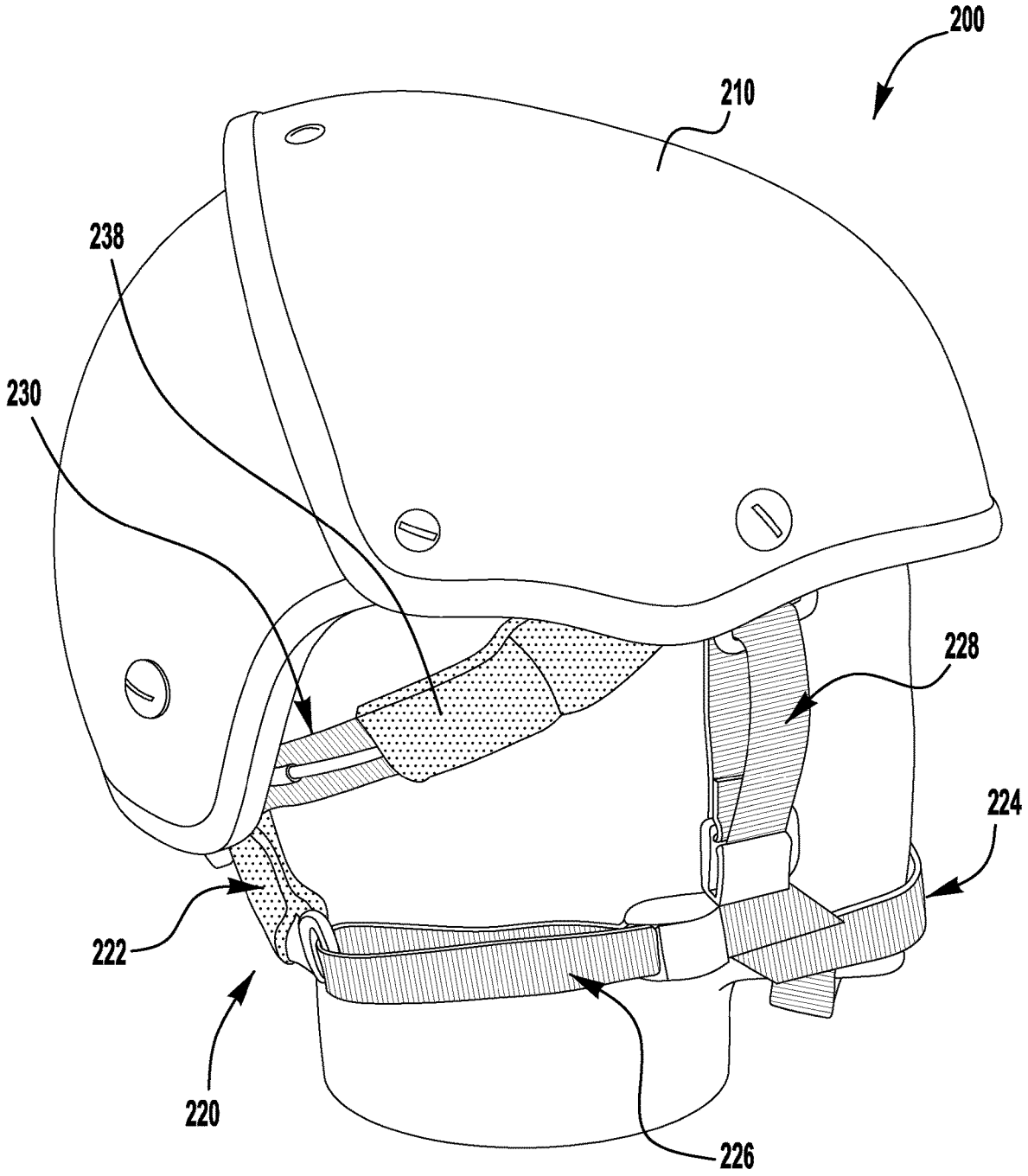
FIG. 2A is a right side view of a helmet having a retention system according to an embodiment of the present application.
Figure 2B:
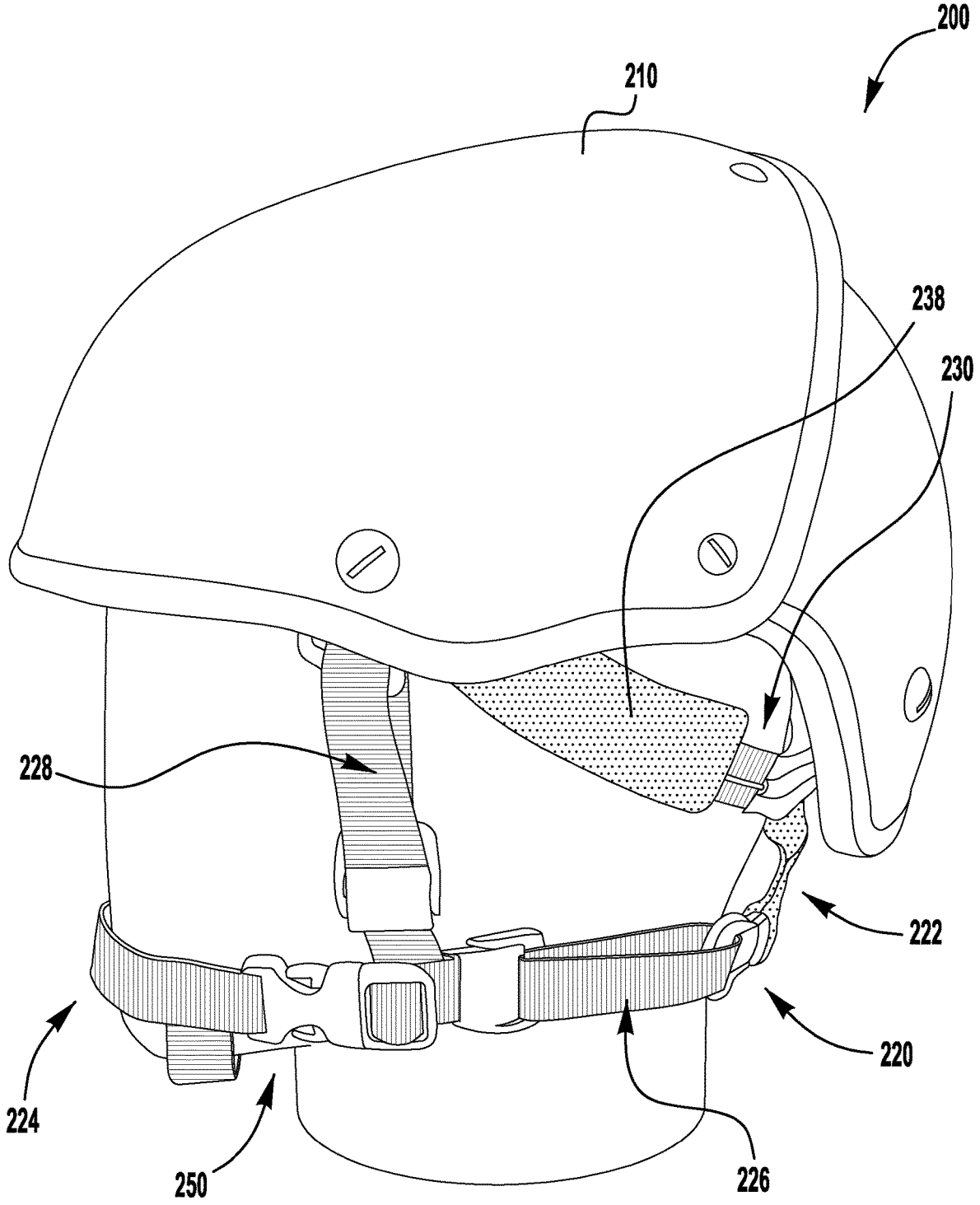
FIG. 2B is a left side view of the helmet of FIG. 2A.
Figure 2C:
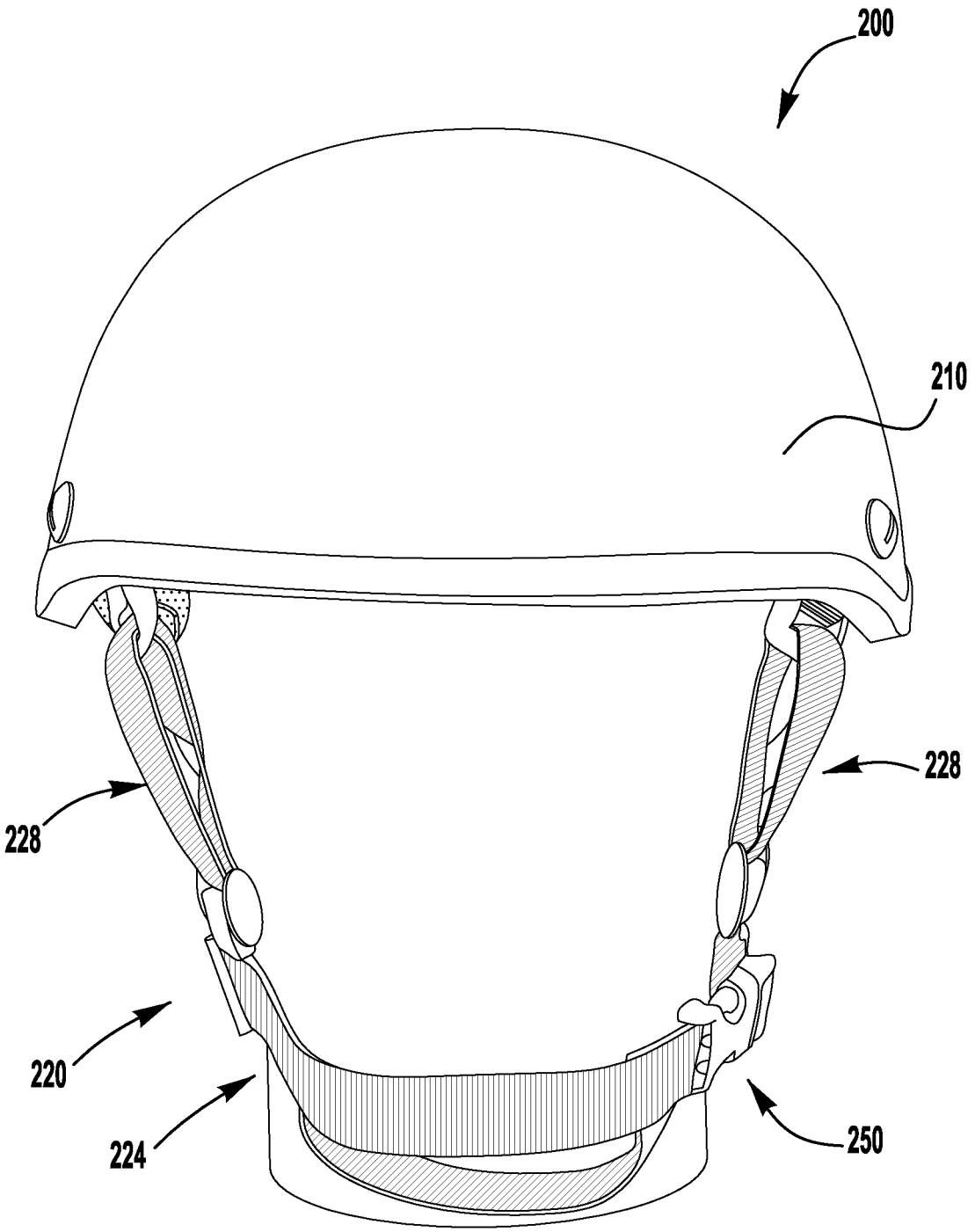
FIG. 2C is a front view of the helmet of FIG. 2A.
Figure 2D:
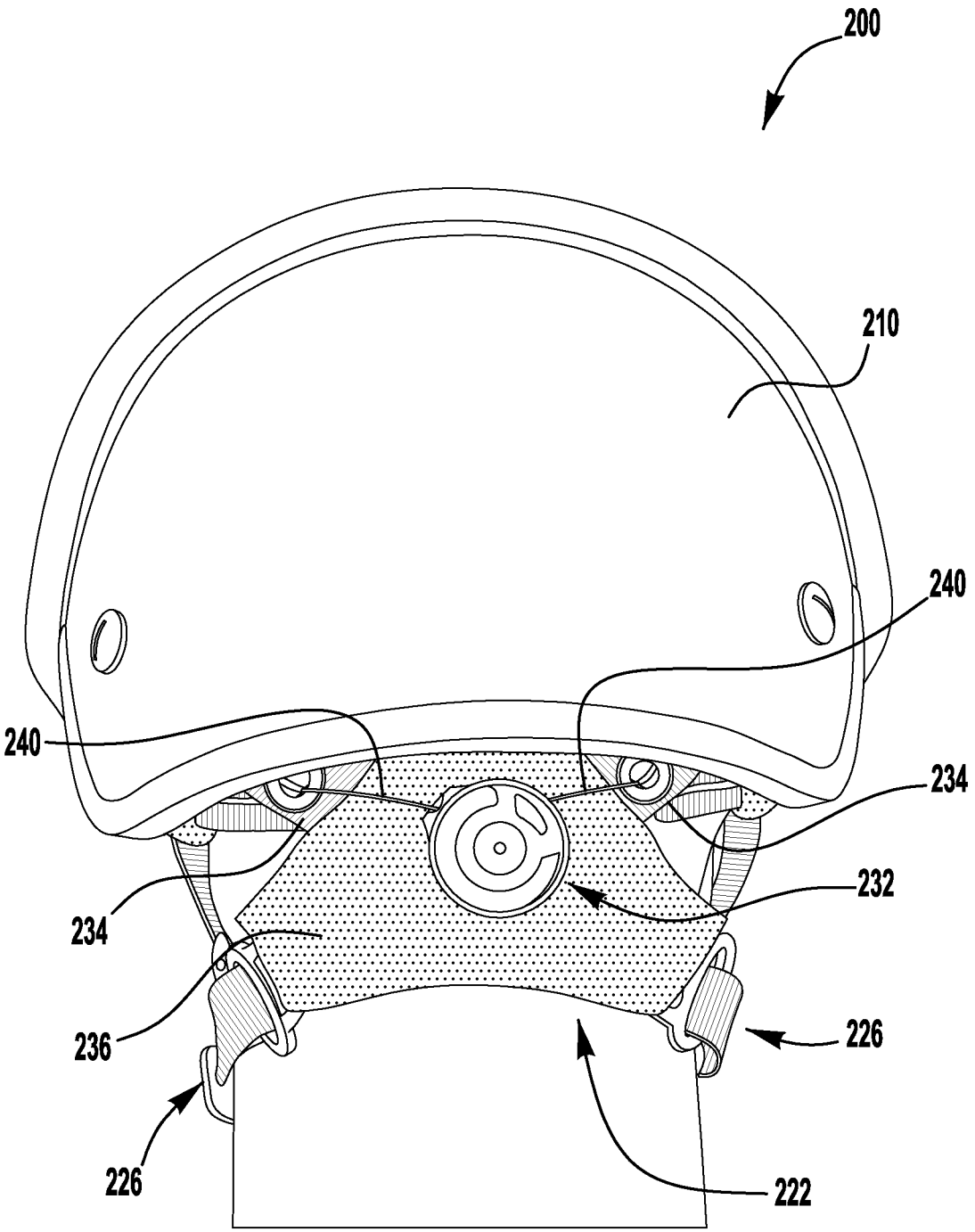
FIG. 2D is a rear view of the helmet of FIG. 2A.

FIGS. 2A-2D illustrate a helmet 200 having a helmet shell 210 and a retention system 220 according to an embodiment of the present application. The retention system 220 is connected to the helmet shell 210 and is configured to hold and stabilize the helmet shell on the user's head. As shown, the retention system 220 comprises a chin portion 224, a rear portion 222, a plurality of straps 226, 228, and 230, and a lacing device 232 (FIG. 2D).

The chin portion 224 of the retention system 220 is configured to receive the chin of the user and acts as a first anchor point of the system. As shown in FIGS. 2A-2C, the chin portion 224 comprises a plurality of flexible straps, or webbing, that are sewn together and are sized and configured to receive the user's chin. However, the chin portion may be configured in a variety of other ways. For example, the chin portion may comprise one or more flexible pieces of fabric or polymer material. Further, the chin portion may comprise a chincup made of one or more components, such as, for example, a polymer or metallic structure formed as a chincup. Further still, the chin portion may comprise a liner material such as ultrasuede or padding material to provide comfort to the user's chin.

The rear portion 222 of the retention system 220 contacts the rear of the user's head, e.g., the occipital or suboccipital portion of the head, and/or the nape of the user's neck and acts as a second anchor point of the system. As shown in FIG. 2D, the rear portion 222 comprises a pad 236 attached to the helmet shell 210 by one or more attachment straps 234 or webbing. At least a portion of the pad 236 extends below the rear edge of the helmet shell 210 such that it is exposed and accessible to the user when wearing the helmet 200. The pad 236 may be a variety of shapes and sizes. As shown in FIG. 2D, the pad 236 is shaped as a truncated triangle with a bottom edge extending substantially the width of the user's neck. The pad 236 comprises a padding material (e.g., foam) with a canvas covering and has a thickness between about 0.1 and 0.5 inches. However, in certain embodiments, the rear portion may or may not be padded and may include one or more pieces of fabric or polymer material.

As illustrated in FIGS. 2A-2D, the retention system 220 comprises a pair of first straps 226, or webbing, connecting the chin portion 224 to the rear portion 222 of the system. The length of each first strap 226 between the chin portion 224 and the rear portion 222 may be selectively adjusted to tighten the rear portion against the user's head and/or neck and the rear of the helmet shell 210 down on the user's head. As illustrated, each first strap 226 comprises a cam lock slider or cam buckle that permits the length of the strap to be selectively adjusted by the user with one hand by pressing down and moving the slider or buckle. However, other strap adjustment devices may be used, such as, for example, various loops, slides, adjusters, clasps, buckles, hook and loop fastener—e.g., Velcro®, or other strap adjustment devices. Further, in certain embodiments, one or more of the first straps may not be adjustable and/or may be made of an elastic material.

The retention system 220 also comprises a pair of second straps 228, or webbing, connecting the chin portion 224 to the front of the helmet shell 210. As illustrated in FIGS. 2A-2C, the second straps 228 extend from the chin portion 224 to the right and left front sides or temple portions of the helmet shell 210. The length of each second strap 228 between the chin portion 224 and the front of the helmet shell 210 may be selectively adjusted to tighten the front of the helmet shell down on the user's head. As illustrated, each second strap 228 comprises a cam lock slider or cam buckle that permits the length of the strap to be selectively adjusted by the user with one hand. However, other strap adjustment devices may be used, such as, for example, a loop, slide, adjuster, clasp, buckle, hook and loop fastener—e.g., Velcro®, or other strap adjustment device. Further, in certain embodiments, one or more of the second straps may not be adjustable and/or may be made of an elastic material.

The retention system 220 also comprises a pair of second straps 228, or webbing, connecting the chin portion 224 to the front of the helmet shell 210. As illustrated in FIGS. 2A-2C, the second straps 228 extend from the chin portion 224 to the right and left front sides or temple portions of the helmet shell 210. The length of each second strap 228 between the chin portion 224 and the front of the helmet shell 210 may be selectively adjusted to tighten the front of the helmet shell down on the user's head. As illustrated, each second strap 228 comprises a cam lock slider or cam buckle that permits the length of the strap to be selectively adjusted by the user with one hand. However, other strap adjustment devices may be used, such as, for example, a loop, slide, adjuster, clasp, buckle, hook and loop fastener—e.g., Velcro®, or other strap adjustment device. Further, in certain embodiments, one or more of the second straps may not be adjustable and/or may be made of an elastic material.

An adjustment device may be used to selectively adjust the length of the third straps 230 between the rear portion 222 and the front of the helmet shell 210. In certain embodiments, the adjustment device is attached to the rear portion 222 and below the rear edge of the helmet shell 210 such that it is exposed and accessible to the user when wearing the helmet. Examples of adjustment devices that may be used include, for example, wire, lacing, or belt systems in which a flexible wire, lace, or belt may be adjusted by winding and unwinding, retracting, or otherwise altering the free length of the wire, lace, or belt, or a system with a rigid or semi-rigid strap that can be driven with a rack and pinion gear, worm drive, or other mechanism to alter the free length of the strap.

As illustrated in FIG. 2D, the adjustment device comprises a wire or lacing device 232 attached to the rear portion 222 below the rear edge of the helmet shell 210. As illustrated, the lacing device 232 is a Boa lacing system, however other adjustable wire, lacing, belt, or strap devices may be used. As described in greater detail below, wires or laces 240 extending from the lacing device 232 are used to selectively adjust the length of the third straps 230 between the rear portion 222 and the front of the helmet shell 210. The wires or laces 240 may comprise a variety of materials, including steel, plastic, or fabric. In one embodiment, the wires or laces 240 are made from Aircraft grade stainless steel.

Figure 3:
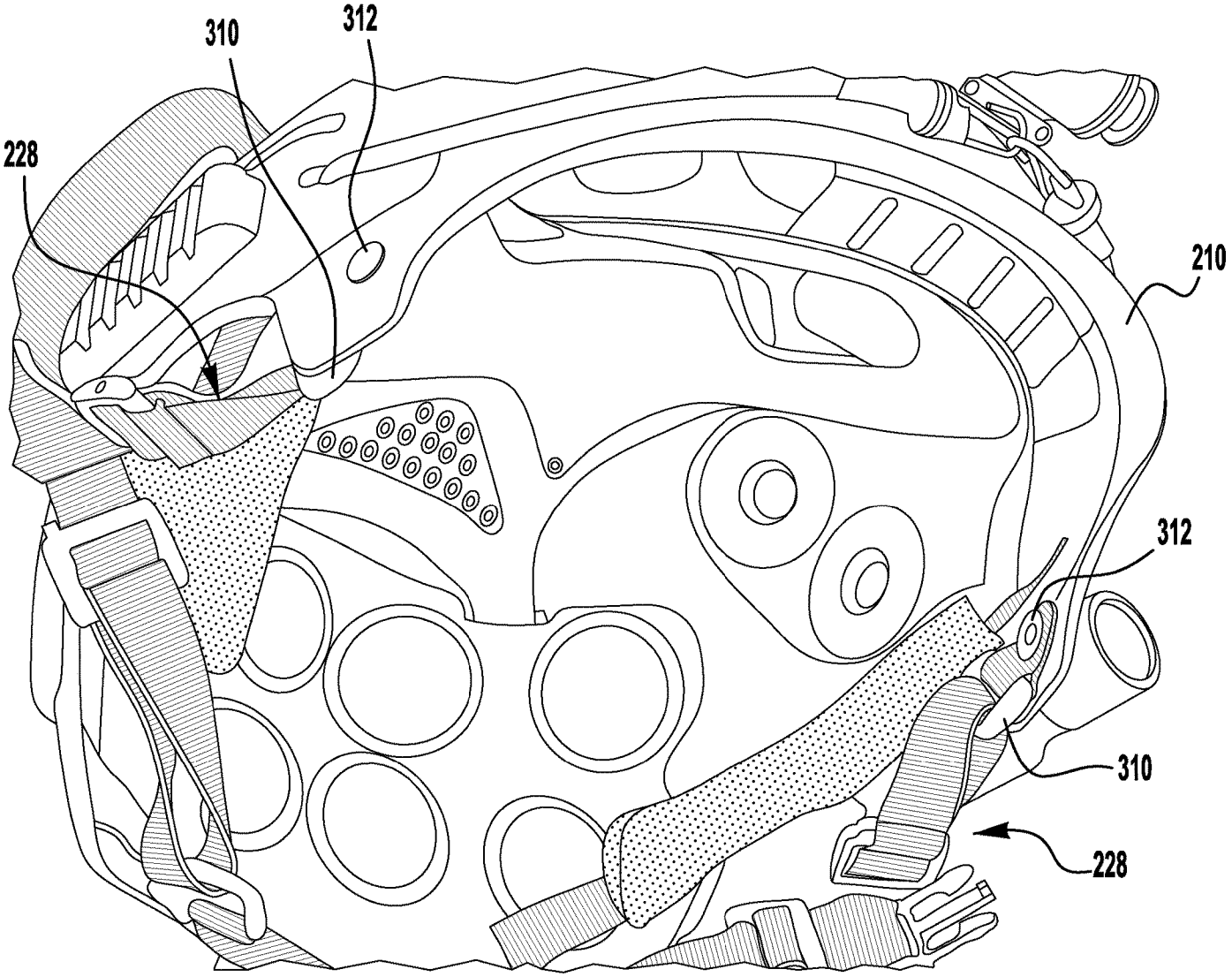
FIG. 3 is a partial bottom perspective view of the inside of a helmet having a retention system according to an embodiment of the present application.

The second, third, and attachment straps 228, 230, and 234 may be attached to the helmet shell 210 in a variety of ways. For example, in certain embodiments, one or more of the straps are attached to a loop or other securing member that is attached to the helmet shell 210 with a fastener, such as a bolt or other fastening device. As an example, FIG. 3 illustrates the second straps 228 attached to a loop 310 that is attached to the helmet shell 210 with a fastener 312. In certain embodiments, a fastener is received through a hole in one or more of the straps to attach the strap directly to the helmet shell. Other methods of attaching the straps to the helmet shell may also be used, such as, for example, by threading the strap through an opening in the helmet shell or by use of an adhesive. Furthermore, any one or more of the second, third, and attachment straps 228, 230, and 234 may be attached to a helmet liner of the helmet shell.

The attachment of any one or more of the second, third, and attachment straps 228, 230, and 234 to the helmet shell 210 may also be adjustable. For example, the loop or other securing member attaching the strap to the helmet shell may be configured such that the distance from the strap attachment point to the helmet attachment point is adjustable. For example, a piece of strap, or webbing, attaching the loop or other securing member to the helmet shell may comprise a plurality of holes that may be used to attach the loop or securing member to the helmet shell. Furthermore, any one or more of the second, third, and attachment straps 228, 230, and 234 may comprise a plurality of holes that may be used to attach the strap directly to the helmet shell.

As illustrated in FIGS. 2B and 2C, the retention system 220 comprises a buckle 250 to permit removal of the retention system and the helmet shell 210 from the head of the user. As illustrated, a first portion of the buckle 250 is attached to the chin portion 224 of the retention system 220 and a second portion of the buckle is attached to the first and second straps 226 and 228 of the retention system. As such, release of the buckle 250 permits the chin portion 224 to be disconnected from the first and second straps 226 and 228 such that the user can remove the helmet 200.

Figure 4A:
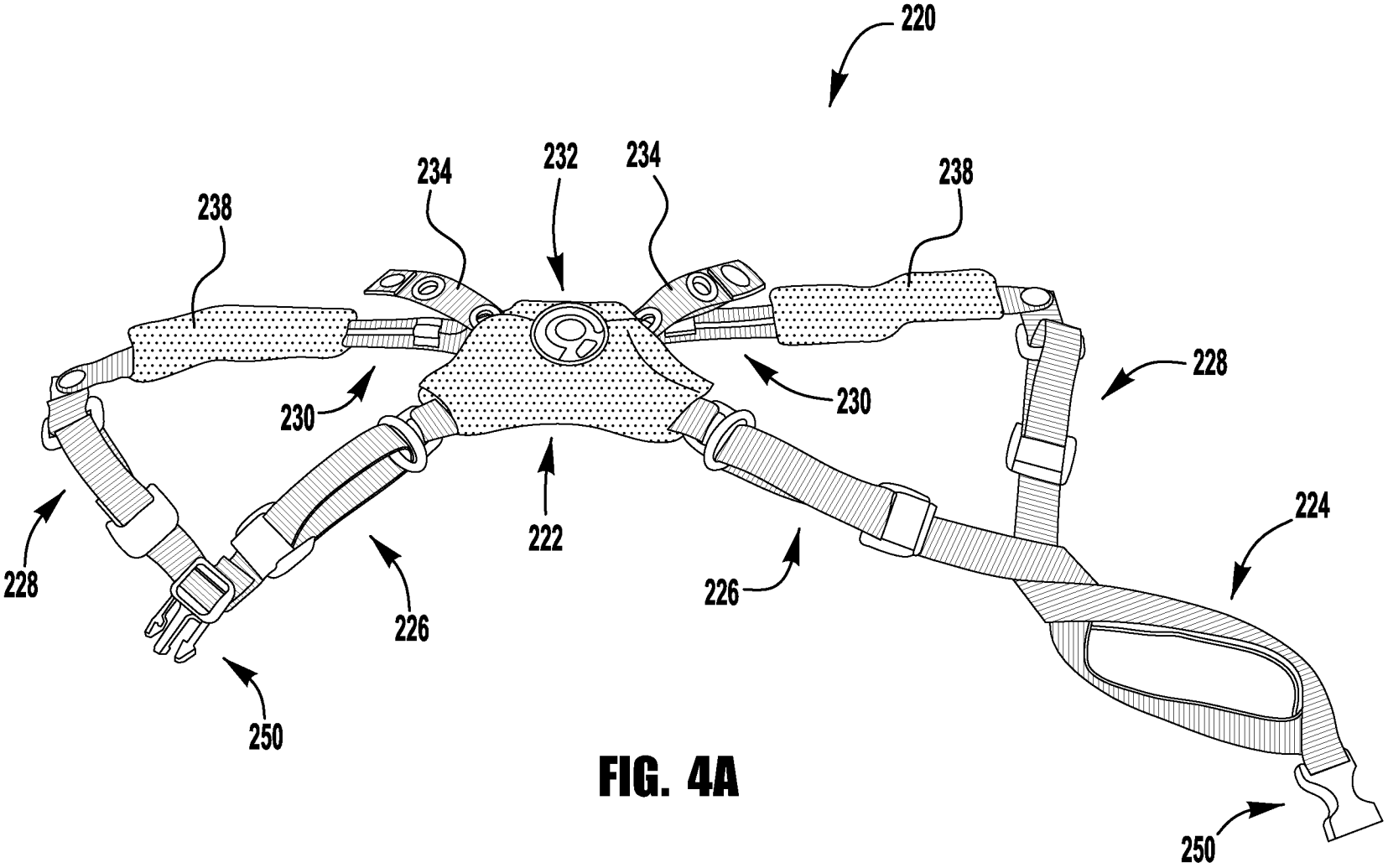
FIG. 4A is a top plan view of the retention system of FIG. 2A removed from the helmet.
Figure 4B:
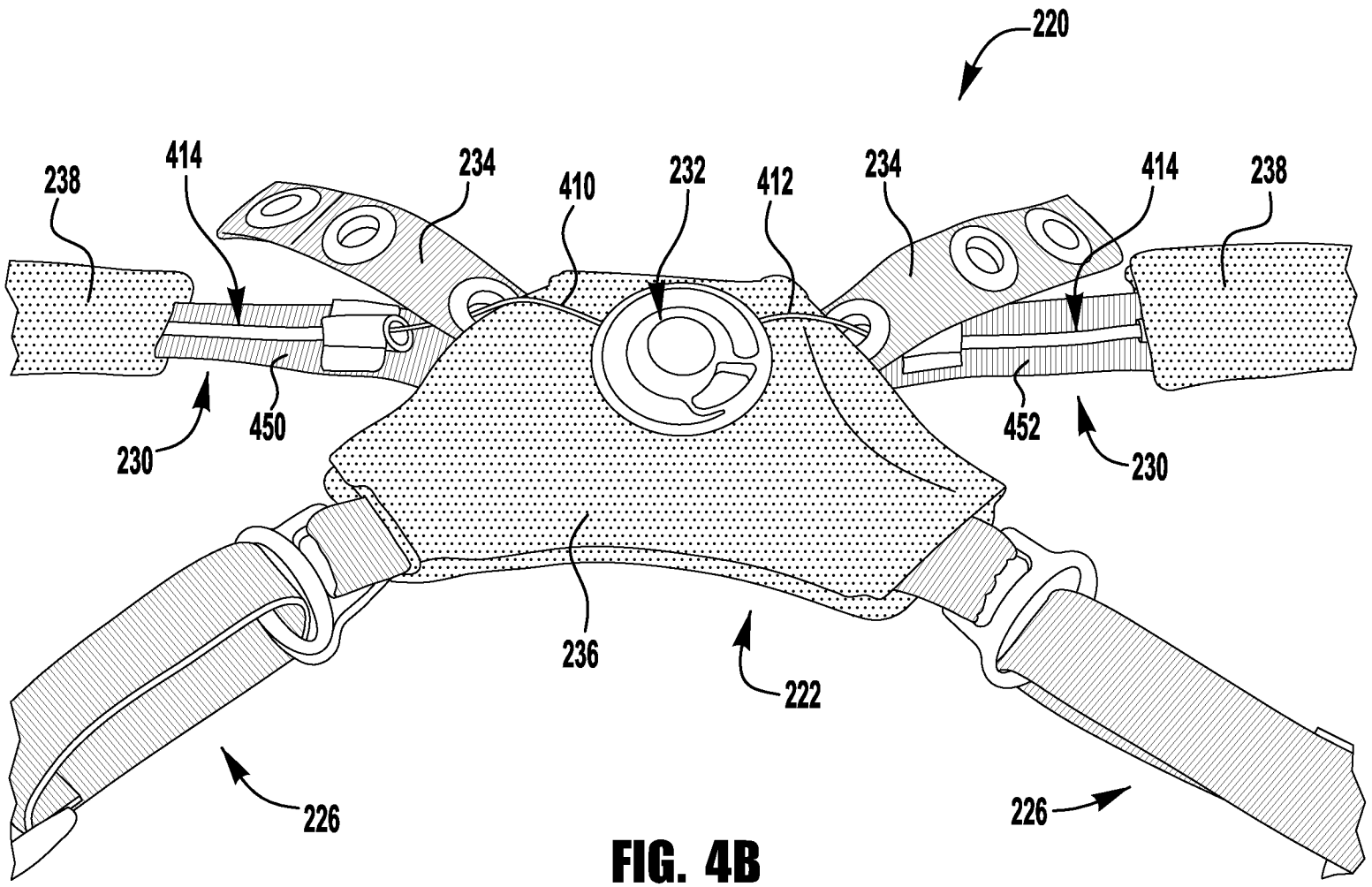
FIG. 4B is a partial top plan view of the retention system of FIG. 4A.
Figure 4C:
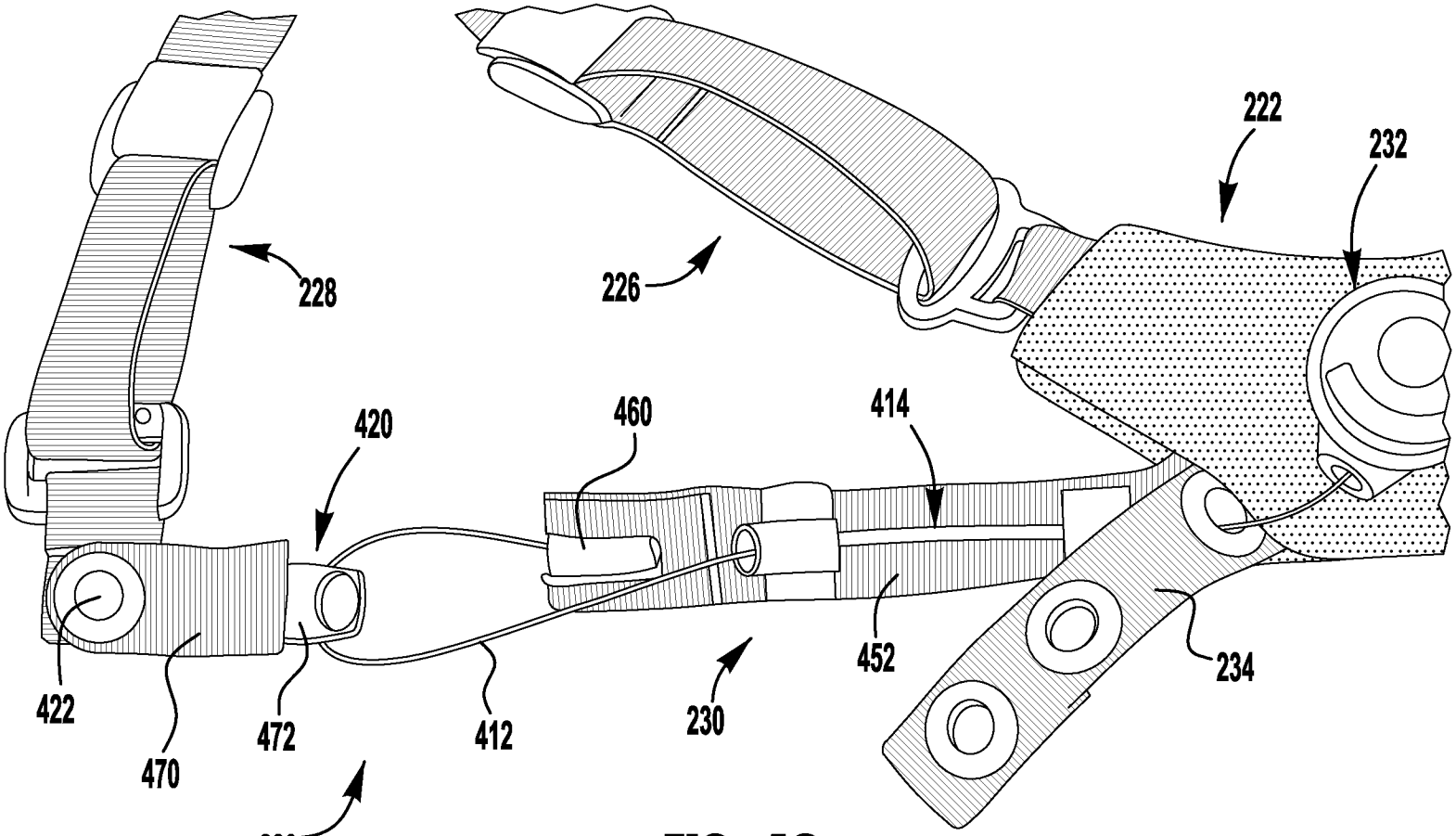
FIG. 4C is a partial top plan view of the retention system of FIG. 4A.

FIGS. 4A-4C illustrate the retention system 220 removed from the helmet shell 210. FIGS. 4A and 4B illustrate the retention system 220 with the comfort pads 238 and FIG. 4C illustrates the retention system with the comfort pads removed.

As illustrated in FIGS. 4A and 4B, first and second lace portions 410 and 412 extend from the lacing device 232 and through openings in the attachment straps 234 of the rear portion 222. The first and second lace portions 410 and 412 are routed through tubes 414 attached to the outer surface of strap segments 450 and 452 of the third straps 230. The tubes 414 movably attach the lace portions 410 and 412 to the strap segments 450 and 452 to permit selective adjustment of the length of each third strap 230 between the rear portion 222 and the front of the helmet shell. However, other means for movably attaching the lace portions to the strap segments may be used. For example, in certain embodiments, one or more eyelets or arches, a sheath, a sleeve, a pocket, a passage or conduit, one or more slots or openings in the strap segment, or the like may be used to movably attach the lace portions to the strap segments.

FIG. 4C illustrates one side of the retention system 220 with the comfort pad removed to better show the connection of the lace portion. Although only one side of the retention system 220 is shown in FIG. 4C, the connection of the lace portion is the same for both sides of the retention system. As, each third strap 230 comprises the strap segment 450 or 452 and the lace portion 410 or 412 attached to the strap segment.

As illustrated in FIG. 4C, the lace portion 412 exits the tube 414 and is routed through a securing member 420 that is configured to be attached to the helmet shell, such as with a fastener inserted through opening 422. The securing member 420 movably attaches the lace portion 412 to the helmet shell to permit selective adjustment of the length of each third strap 230 between the rear portion 222 and the front of the helmet shell. The end of the lace portion 412 is then attached to the strap segment 452 of the third strap 230.

As illustrated in FIG. 4C, the securing member 420 comprises a strap segment 470 that is configured to be attached to the helmet shell and a clip 472 that movably attaches the lace portion 412 to the helmet shell. However, other means for movably attaching the lace portion to the helmet shell may be used. For example, in certain embodiments, an opening in the helmet shell, an opening in a strap segment, an eyelet, a loop, a ring, a clip, a sheath, a sleeve, a passage, a conduit, a buckle, a fastener, or the like may be used to movably attach the lace portion to the helmet shell.

As illustrated in FIG. 4C, the end of the lace portion 412 comprises an enlarged portion 460 that is attached to the strap segment 452 by folding an end of the strap segment over and attaching it to itself to hold the enlarged portion in place. However, a variety of other methods may be used to attach the end of the lace portion 412 to the strap segment 452, such as, for example, by routing the lace portion through an opening in the strap segment or using an adhesive, a loop or other fastening device to secure the lace portion to the strap segment. As illustrated in FIGS. 4A and 4B, the comfort pads 438 are configured to at least partially surround the connection and exposed lace portions 410 and 412 to protect the lace portions and provide comfort to the side of the user's head.

The lacing device 232 may be manipulated to retract the first and second lace portions 410 and 412 into the lacing device (e.g., by rotating a dial of the lacing device). When this occurs, each lace portion 410 and 412 is moved in a first direction through the tube 414 and securing member 420 and the end of the strap segment 450 and 452 is pulled toward the securing member. As illustrated in FIGS. 2A-2C, the securing members are attached at the right and left front sides or temple portions of the helmet shell 210. As such, when the lace portions 410 and 412 are retracted into the lacing device 232, at least portions of the third straps 230 are tightened against the sides of the user's head and the rear portion 222 is pulled in a direction forward and upward against the rear of the user's head to fit the retention system 220 around the circumference of the user's head and stabilize the helmet shell 210 on the user's head.

The lacing device 232 may also be manipulated to release the first and second lace portions 410 and 412 and permit the lace portions to be pulled out of the lacing device (e.g., by pulling up on a dial of the lacing device). When this occurs, each lace portion 410 and 412 is permitted to move in a second direction through the tube 414 and securing member 420 and the strap segment 450 and 452 is permitted to move away from the securing member. As such, the third straps 230 and the rear portion 222 of the retention system 220 are loosened to facilitate removal of the helmet shell 210 from the user's head. In certain embodiments, the lacing device 232 may be used to move the lace portions 410 and 412 in the second direction through the tube 414 and the securing member 420. Further, the lacing device 232 may be used to move the strap segments 450 and 452 away from the securing members 420.

Figure 5:
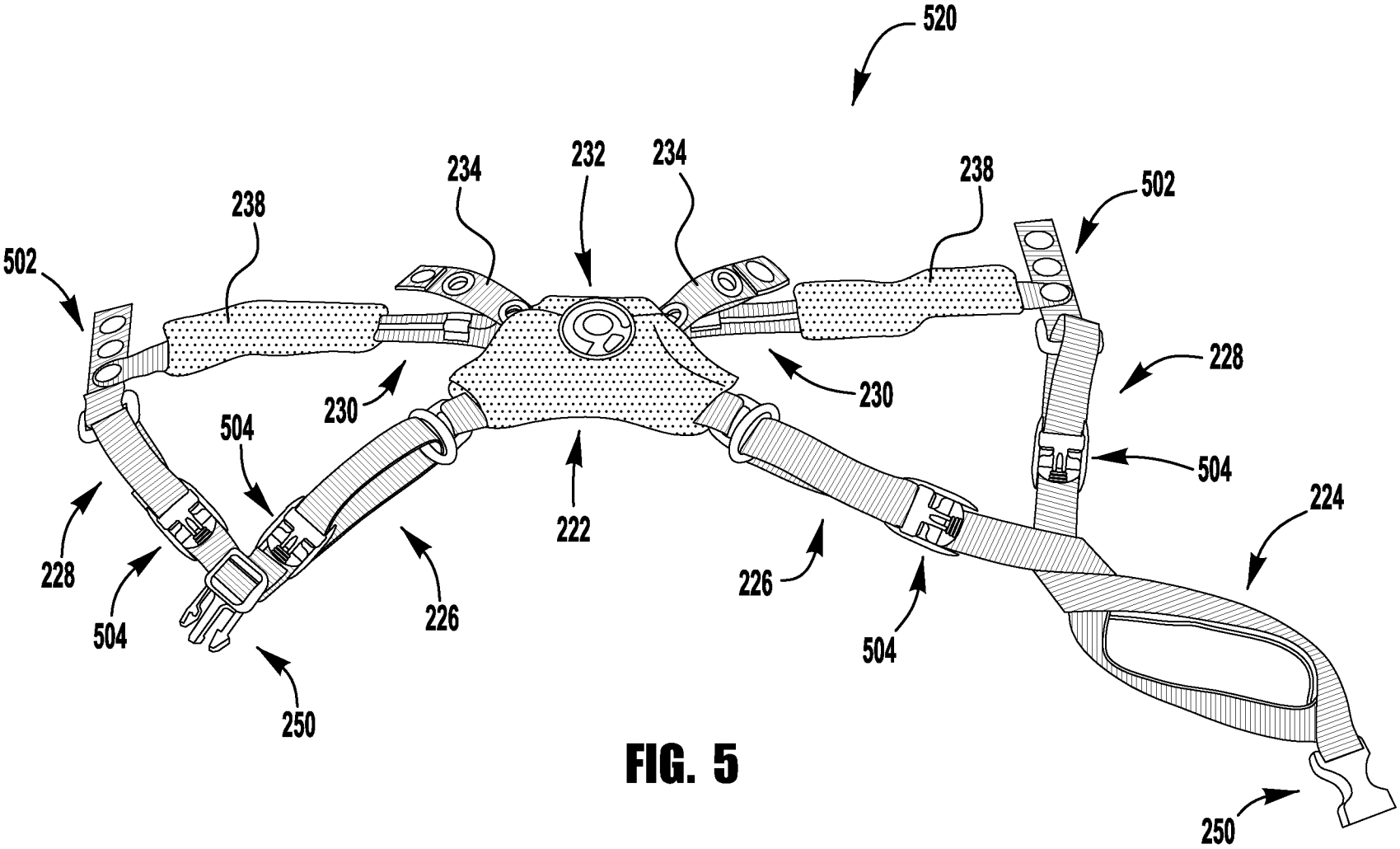
FIG. 5 is a top plan view of a retention system removed from a helmet and according to an embodiment of the present application.

FIG. 5 illustrates a retention system 520 removed from the helmet shell. The retention system 520 is similar to the retention system 220 and, when connected to the helmet shell, is configured to hold and stabilize the helmet shell on the user's head. Similar to retention system 220, the retention system 520 comprises a chin portion 224, a rear portion 222, a plurality of straps 226, 228, and 230, and a lacing device 232. Each first and second strap 226 and 228 of the retention system 520 comprises a cam lock slider or cam buckle 504 that permits the length of the strap to be selectively adjusted by the user with one hand by flipping the top open and moving the slider or buckle. Further, the attachment point of each second and third strap 228 and 230 to the helmet shell is adjustable. As illustrated, an end portion 502 of each second strap 228 comprises a plurality of holes that may be used to attach the second and third straps to the helmet shell.

An exemplary method of adjusting the fit of a helmet on a user's head is described below. A retention system of the present application is attached to a helmet shell to stabilize the helmet on the user's head. In certain embodiments, the retention system comprises a rear portion connected to the rear of the helmet shell, at least one strap extending from the rear portion to a front portion of the helmet shell, and an adjustment device attached to the rear portion. The strap comprises a strap segment extending from the rear portion and an elongated member attached to the strap segment and movable relative to the helmet shell. The adjustment device is used to selectively adjust the elongated member and move the strap segment relative to the helmet shell to adjust the length of the strap between the rear portion and the front portion of the helmet shell.

When the adjustment device is used to move the strap segment in a first or forward direction toward the front portion of the helmet, the strap is tightened against the side of the user's head and the rear portion is pulled in a direction forward and upward against the rear of the user's head to fit the retention system on the user's head and stabilize the helmet shell on the user's head. Further, when the adjustment device is used to move or permit movement of the strap segment in a second or rearward direction away from the front portion of the helmet, the strap and the rear portion are loosened to facilitate removal of the helmet shell from the user's head.

In certain embodiments, the retention system comprises a securing member attached to the front portion of the helmet shell that movably attaches the elongated member to the helmet shell. The adjustment device is used to move the elongated member through the securing member and the strap segment toward the securing member to decrease the length of the strap between the rear portion and the front portion of the helmet shell. Further, the adjustment device is used to permit movement of the elongated member through the securing member and the strap segment away from the securing member to increase the length of the strap between the rear portion and the front portion of the helmet shell.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, component geometries, shapes, and dimensions can be modified without changing the overall role or function of the components. Therefore, the inventive concept, in its broader aspects, is not limited to the specific details, the representative device, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A helmet, comprising:

a helmet shell having left and right temple portions and a rear portion; and a retention system attached to the helmet shell, the retention system comprising:

a moveable rear portion connected to the rear portion of the helmet shell;

an adjustment device attached to the moveable rear portion;

a chin portion configured to receive a chin of a user;

left and right securing members attached to the left and right temple portions of the helmet shell;

left and right front chin straps extending from the chin portion to the left and right securing members, wherein a length of each of the left and right front chin straps is selectively adjustable;

left and right rear chin straps extending from the chin portion to the movable rear portion, wherein a length of each of the rear chin straps is selectively adjustable;

left and right side straps extending between the movable rear portion to the left and right temple portions of the helmet shell, wherein a length of each of the left and right side straps is selectively adjustable, and wherein the left and right side straps further comprise:

left and right strap segments; and left and right elongated members extending from the adjustment device to engage the left and right strap segments, respectively, wherein a length of each of the left and right elongated members is adjusted by the adjusting device;

wherein adjusting the length of the left and right elongated members with the adjustment device:

adjusts the length of the left and right side straps;

tightens at least a portion of the left and right side straps against a left side and a right side, respectively, of a head of the user when the left and right side straps are shortened; and pulls the rear portion forward and upward against a rear portion of the head of the user when the left and right side straps are shortened.

2. The helmet of claim 1, wherein the left and right elongated members are routed through the left and right securing members before engaging the left and right strap segments.

3. The helmet of claim 1, wherein the left and right strap segments extend from the moveable rear portion.

4. The helmet of claim 1, wherein the left and right elongated members are moveably attached to the left and right strap segments by left and right attachment members, respectively.

5. The helmet of claim 4, wherein:

the left and right elongated members move through the left and right securing members, respectively; and reducing the length of the left and right elongated members moves the left and right attachment members closer to the left and right securing members, respectively.

6. The helmet of claim 1, wherein:

the left and right securing members each comprise a fastener;

the left front chin strap and the left side strap attach to the fastener of the left securing member; and the right front chin strap and the right side strap attach to the fastener of the right securing member.

7. The helmet of claim 1, wherein the moveable rear portion extends below a rear edge of the helmet shell such that the adjustment device attached to the moveable rear portion is exposed and accessible to a user wearing the helmet.

8. The helmet of claim 1, wherein left and right attachment straps attach the moveable rear portion to the rear portion of helmet shell.

9. The helmet of claim 8, wherein a width between the left and right attachment straps at the rear portion of the helmet shell is greater than a width of the moveable rear portion.

10. The helmet of claim 8, wherein:

the left attachment strap and the right rear chin strap extend from the moveable rear portion at locations on the moveable rear portion that are opposite to each other; and the right attachment strap and the left rear chin strap extend from the moveable rear portion at locations on the moveable rear portion that are opposite to each other.

11. A retention system for a helmet, comprising:

a pair of first adjustable straps, each first adjustable strap having a length that is selectively adjustable, wherein each first adjustable strap comprises a strap segment and a lace attached to the strap segment;

a pair of second adjustable straps, each second adjustable strap having a length that is selectively adjustable;

a pair of third adjustable straps, each third adjustable strap having a length that is selectively adjustable;

a pair of securing members for attaching the retention system to left and right temple portions of the helmet, each securing member being connected to one of the first adjustable straps and one of the second adjustable straps;

a chin portion connected to the pair of second adjustable straps and to the pair of third adjustable straps;

a padded portion for attaching the retention system to a rear portion of the helmet, the padded portion being connected to the pair of first adjustable straps and the pair of third adjustable straps; and a lacing device attached to the padded portion and configured to selectively adjust a length of the laces of the first adjustable straps to adjust the length of the first adjustable straps;

wherein shortening the first adjustable straps when the retention system is attached to the helmet tightens the first adjustable straps against a side of a head of the user wearing the helmet and pulls the padded portion forward and upward against a rear portion of the head of the user wearing the helmet.

12. The retention system of claim 11, the laces are routed through the securing members before attaching to the strap segments.

13. The retention system of claim 11, wherein the strap segments of the first adjustable straps extend from the padded portion.

14. The retention system of claim 11, wherein the laces are moveably attached to the strap segments by attachment members.

15. The retention system of claim 14, wherein:

the laces move through the securing members; and reducing a length of the laces moves the attachment members closer to the securing members.

16. The retention system of claim 11, wherein:

the securing members each comprise a fastener; and the first and second adjustable straps attach to the fastener.

17. The retention system of claim 11, further comprising:

a pair of attachment straps for attaching the padded portion of the retention system to the rear portion of the helmet;

wherein one of the attachment straps and one of the third adjustable straps extend from the padded portion at locations on the padded portion that are opposite to each other; and wherein the other of the attachment straps and the other of the third adjustable straps extend from the padded portion at locations on the padded portion that are opposite to each other.

18. A helmet including a helmet shell and the retention system of claim 11 attached to the helmet shell.

19. A method of adjusting a helmet, comprising the steps of:

using a retention system attached to a helmet shell to stabilize a helmet on a user's head, the retention system comprising:

a pair of first adjustable straps, each first adjustable strap having a length that is selectively adjustable, wherein each first adjustable strap comprises a strap segment and an elongated member attached to the strap segment;

a pair of second adjustable straps, each second adjustable strap having a length that is selectively adjustable;

a pair of third adjustable straps, each third adjustable strap having a length that is selectively adjustable;

a pair of securing members for attaching the retention system to left and right temple portions of the helmet shell, each securing member being connected to one of the first adjustable straps and one of the second adjustable straps;

a chin portion connected to the pair of second adjustable straps and to the pair of third adjustable straps;

a moveable rear portion for attaching the retention system to a rear portion of the helmet, the moveable rear portion being connected to the pair of first adjustable straps and the pair of third adjustable straps; and an adjustment device attached to the moveable rear portion and configured to selectively adjust a length of the elongated members of the first adjustable straps to adjust the length of the first adjustable straps;

using the adjustment device to adjust the lengths of the first adjustable straps, wherein shortening the first adjustable straps tightens the first adjustable straps against a side of a head of the user wearing the helmet and pulls the moveable rear portion forward and upward against a rear portion of the head of the user wearing the helmet.

20. The method of claim 19, further comprising at least one of:

adjusting the length of at least one of the first adjustable straps without changing the lengths of the second or third adjustable straps;

adjusting the length of at least one of the second adjustable straps without changing the lengths of the first or third adjustable straps; and adjusting the length of at least one of the third adjustable straps without changing the lengths of the first or second adjustable straps.

* * * * *